US007747207B2

(12) United States Patent
Tanaka et al.

(10) Patent No.: US 7,747,207 B2
(45) Date of Patent: Jun. 29, 2010

(54) IMAGE FORMING APPARATUS CONTROLLING A DROPLET SIZE OF A FIXING SOLUTION

(75) Inventors: Atsushi Tanaka, Kashihara (JP); Kenji Asakura, Kyoto (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 800 days.

(21) Appl. No.: 11/707,911

(22) Filed: Feb. 20, 2007

(65) Prior Publication Data

US 2007/0196146 A1 Aug. 23, 2007

(30) Foreign Application Priority Data

Feb. 21, 2006 (JP) ..... P2006-044457

(51) Int. Cl.
*G03G 15/20* (2006.01)

(52) U.S. Cl. ..... 399/340; 399/45

(58) Field of Classification Search ..... 399/340, 399/122, 45, 68

See application file for complete search history.

(56) References Cited

U.S. PATENT DOCUMENTS

| | | | |
|---|---|---|---|
| 5,890,043 | A | 3/1999 | Uehara et al. |
| 6,753,304 | B1 | 6/2004 | Barthelemy et al. |
| 6,947,700 | B2 | 9/2005 | Kurotori et al. |
| 7,149,441 | B2 | 12/2006 | Akita et al. |

FOREIGN PATENT DOCUMENTS

| | | | |
|---|---|---|---|
| CN | 2128006 | | 3/1993 |
| CN | 1603976 | A | 4/2005 |
| JP | 9-99607 | A | 4/1997 |
| JP | 10-63121 | A | 3/1998 |
| JP | 2001-188426 | A | 7/2001 |
| JP | 2002-508439 | | 3/2002 |
| JP | 2004-109747 | A | 4/2004 |
| JP | 2004-109751 | A | 4/2004 |
| JP | 2004-151626 | A | 5/2004 |
| JP | 2004-294847 | A | 10/2004 |

*Primary Examiner*—David M Gray
*Assistant Examiner*—Laura K Roth
(74) *Attorney, Agent, or Firm*—Birch, Stewart, Kolasch & Birch, LLP

(57) ABSTRACT

An image forming apparatus includes a toner image forming section, an intermediate transferring section, a transferring section, a fixing solution applying section, a transporting section, a fixing section, and a recording medium feeding section. In the image forming apparatus, the fixing solution applying section includes a droplet supplying section, a recording medium detecting section, and a control unit, wherein the recording medium is heated before or at the same time when the fixing solution is applied to the recording medium by the fixing solution applying section, and a size of droplets of the fixing solution supplied to the recording medium is controlled based on the type of the recording medium.

10 Claims, 5 Drawing Sheets

IMAGE FORMING APPARATUS CONTROLLING A DROPLET SIZE OF A FIXING SOLUTION

CROSS-REFERENCE TO RELATED APPLICATION

This application claims priority to Japanese Patent Application No. 2006-44457, which was filed on Feb. 21, 2006, the contents of which, are incorporated herein by reference, in their entirety.

BACKGROUND OF THE INVENTION

1. Field of the Invention

The present invention relates to an image forming apparatus.

2. Description of the Related Art

An electrophotographic method-based image forming apparatus finds wide application in copying machines, printers, facsimile machines, or the like equipment. In general, image formation is accomplished in the following manner. Firstly, there is prepared a photoreceptor having a photosensitive layer containing a photoconductive substance formed on the surface thereof. After the surface of the photoreceptor is electrically charged uniformly, an electrostatic latent image corresponding to image data is formed thereon through a few different image-forming process steps. The electrostatic latent image is developed into a toner image with use of a developing agent containing toner supplied from development section. The toner image is directly transferred onto a recording medium such as a paper sheet, or transferred onto an intermediate transfer medium once, and is thereafter transferred onto a recording medium. On the recording medium, the toner image is heated and pressurized, and is eventually fixed thereon by a fixing section such as a development roller according to a heat fixing method.

An example of the image forming apparatuses of heat fixing has a configuration in which an intermediate transfer belt, eventually a toner image transferred onto the intermediate transfer belt is heated by extending the intermediate belt, which is an intermediate transfer medium, by heating rollers, and the toner image is transferred and fixed onto a recording medium while being heated (refer to Japanese Unexamined Patent Publication JP-A 10-63121 (1998), for example). The image forming apparatus of JP-A 10-63121 is characterized by consuming a relatively small electric power. However, in this image forming apparatus, the recording medium is not heated, and therefore when a toner image is brought in contact with the recording medium for transfer and fixing, the temperature of the toner image is reduced, so that the toner image may not be fixed or image deterioration due to offset or the like may occur. Moreover, an image forming apparatus is proposed in which the toner image on the intermediate transfer belt is heated and the recording medium on which the toner image has not been transferred or fixed yet is also heated, and the toner image is transferred and fixed on the recording medium while being heated (refer to Japanese Unexamined Patent Publication JP-A 2004-151626, for example). With the image forming apparatus of JP-A 2004-151626, the adhesion of the toner image to the recording medium is improved, but since not only the toner image, but also the recording medium is heated, a heating section with a large heat capacity is required, thereby increasing power consumption and resulting in a current situation in which the heating section consumes at least a half of the total power consumed in the image forming apparatus.

On the other hand, saving energy is a current trend to counter global warming, and electrophotographic image forming apparatuses are widely used. For these reasons, also in electrophotographic image forming apparatuses, there is a demand for reducing power consumption when the toner image is fixed onto the recording medium. Furthermore, in the heat fixing, as described above, the heating section is used inside the apparatus, and the inside of the apparatus reaches a high temperature, so that it is necessary to increase the heat resistance of the components thereof, thereby increasing the material cost. In addition, in the heat fixing, since fixing is not performed until the fixing portion reaches a predetermined temperature, and therefore a time until the predetermined temperature is reached, that is, a warm-up time is often necessary. Furthermore, the heat fixing has a problem in that fixing of a multicolored toner image onto a recording medium takes more time than fixing a monochromatic toner image. Therefore, there is a demand for shortening the time for fixing a multicolored toner image. In view of these demands, wet fixing employing a fixing solution containing water and a liquid that can be dissolved or dispersed in water and has an action of softening or swelling toner is proposed. In the wet fixing, a toner image that is softened or swollen by application of the fixing solution is attached to a recording medium, and pressed so that the toner image is fixed onto the recording medium. The wet fixing consumes the power much less than the heat fixing, and therefore the wet fixing is useful in view of saving energy. Furthermore, the time for fixing a multicolored toner image can be shortened, compared with the heat fixing, because a large amount of heat capacity is not necessary. Therefore, various further improvements of the wet fixing are proposed.

For example, there has been proposed a fixing apparatus in which a jet of fixer fluid ejected from a fixer fluid ejecting member having a plurality of pores is applied relatively to a toner image carried on an intermediate transfer medium or a recording medium, the fixer fluid being applied only to a part to which toner is attached and heated (refer to Japanese Unexamined Patent Publication JP-A 2004-109747, for example). That is to say, in this fixing device, after a fixing solution is applied to a toner image on an intermediate transfer medium or a recording medium, heating is performed. However, an unfixed toner image is merely an aggregate in which toner particles gather without being physically or chemically bonded at room temperature. Therefore, when a liquid such as the fixing solution is applied directly to an unfixed toner image, a flow or an aggregation of toner particles tends to occur before the toner particles are softened and/or swollen, and bonded firmly to each other. As a result, a blur is generated in the image edge after fixing, and non-uniformity occurs in a half tone portion that should be uniform, so that high definition images cannot be achieved. It is natural that even when heating is performed after flow or aggregation of toner particles occurs, the original state cannot be recovered. Furthermore, in the fixing device of JP-A 2004-109747, in the case of letting a toner image carried on the intermediate transfer medium, an intermediate transfer belt, which is the intermediate transfer medium, is subjected to water-repellent treatment such as a treatment with fluorine. Therefore, even when the fixing solution is applied to an area where a toner image is formed of the intermediate transfer belt, the fixing solution is present only in the portion where toner is attached (image portion) of the area where a toner image is formed without staying in the portion where toner is not attached (non-image portion) between the portions where toner is attached. However, when the fixing solution is applied only to the image portion in the recording medium, expansion and contraction occurs in the image portion, and does not occur in the non-image portion, so that wrinkles originating from the image portion are inevitably generated. In particular, when recording paper made from paper fiber with water is used as the recording medium, this tendency is significant. In the case where the minimum amount of the fixing solution necessary to swell toner is applied, this problem can be avoided. However, the minimum amount is very small, so that it is difficult to weigh the minimum amount accurately. Moreover, when the fixing solution is applied only to the image portion, toner attached to the non-image portion surrounding the image portion, for example, due to fogging remains on the recording medium without being fixed, so that the unfixed toner may soil hands or clothing.

In the image forming apparatus of JP-A 10-63121, it is possible to apply the fixing solution to a toner image when transferring and fixing the toner image on the heated transfer belt onto a recording medium that is not heated. However, a large amount of fixing solution is necessary in order to enhance the adhesion between the toner image and the recording medium and between the toner particles, in the case where heat is not supplied for transfer and fixing and there is no particular measure for that, as in JP-A 10-63121. When a large amount of fixing solution is used, wrinkles or curling is inevitably generated in the recording medium. Moreover, it is necessary to often supply the fixing solution or necessary to provide a large capacity tank for storing the fixing solution, resulting in poor maintainability or increase in the size of the apparatus. Furthermore, when toner images on resin recording media such as sheets for over heat projectors (hereinafter, referred to as "OHP sheets"), recording media having a resin layer on its surface or other media through which the fixing solution hardly permeates are fixed with the conventional wet fixing type image forming apparatus, the adhesion of toner becomes insufficient, and toner images may partially peel off.

SUMMARY OF THE INVENTION

It is an object of the invention to provide an image forming apparatus involving wet fixing that causes no flow or aggregation of toner and eventually no disturbance of toner image as a result of application of a fixing solution, generates no curling or wrinkles in a recording medium, can reduce an amount of heat energy and eventually power consumption and consumption of the fixing solution, takes a relatively short time to fix even a multicolored toner image, and can fix toner with large adhesion on a recording medium through which the fixing solution hardly permeates.

The invention provides an image forming apparatus comprising:

a toner image forming section for forming a toner image;

a transferring section for transferring, to a recording medium, the toner image that has been formed by the toner image forming section;

a fixing solution applying section for applying, to a surface of the recording medium, a fixing solution containing water and an organic solvent which fixing solution softens and/or swells toner, and fixes the toner onto the recording medium; and a heating section for heating an another side of the recording medium different from one side to which the fixing solution is applied, before or during the fixing solution is applied to the one side of the recording medium by the fixing solution applying section, wherein the fixing solution applying section includes:

a droplet supplying section for supplying the fixing solution to the recording medium while forming the fixing solution into droplets;

a recording medium detecting section for detecting a type of the recording medium; and a droplet size controlling section for controlling a size of the droplets of the fixing solution formed by the droplet supplying section, based on a result detected by the recording medium detecting section, and wherein the fixing solution applying section applies the fixing solution in the form of droplets to the recording medium while the size of the droplets is controlled based on the type of the recording medium.

Furthermore, in the invention, it is preferable that the fixing solution applying section applies the droplets which are controlled by the droplet size controlling section so as to have a smaller size than that of droplets supplied in a case where the recording medium is a plain paper, from the droplet supplying section to the recording medium, when the recording medium detecting section detects that the recording medium is a plastic sheet or a recording medium having a resin layer on the surface thereof.

According to the invention, an image forming apparatus involving wet fixing, comprises a toner image forming section, a transferring sections, a fixing solution applying section, and a heating section, wherein the fixing solution applying section includes a droplet supplying section, a recording medium detecting section, and a droplet size controlling section. With this image forming apparatus, the size of droplets of the fixing solution supplied to a recording medium is changed into a size suitable for the recording medium, based on the type (such as the thickness) of the recording medium. For example, when the recording medium detecting section detects that the recording medium is an OHP sheet, then the droplet size controlling section controls the size of the droplets of the fixing solution supplied by the droplet supplying section, into a size smaller than a size in a case where the recording medium is a plain paper. With this configuration, for example, a disturbance of the toner image, wrinkles and curling in the recording medium caused by application of the fixing solution are prevented, and thus toner can be fixed with sufficient adhesion even onto a recording medium through which the fixing solution hardly permeates, such as an OHP sheet. Furthermore, since an appropriate amount of the fixing solution is applied to the toner image, no disturbance is caused in an image even in the case of a multicolored toner image, and the time taken for fixing is relatively short. Furthermore, since the fixing solution in an appropriate amount for fixing the toner image can be applied by controlling the size of the droplets, unnecessary consumption of the fixing solution is prevented, and thus the amount of the fixing solution consumed can be reduced. Also, by controlling the size of the droplets as described above, the function of the fixing solution is exerted substantially to the maximum, and thus heating by the heating section can kept to the minimum necessary, so that the amount of electric power consumption can be also reduced. Accordingly, the image forming apparatus of the invention can form high-quality images stably using wet fixing.

Furthermore, in the invention it is preferable that the image forming apparatus further comprises:

a transporting section for transporting the recording medium; and a transport speed controlling section for controlling a transport speed of the recording medium that is transported by the transporting section, and when the recording medium detecting section detects that the recording medium is a plastic sheet or a recording medium having a resin layer on the surface thereof, then the transport speed controlling section controls the transport speed of the recording medium that is transported by the transporting section, into a speed lower than a speed in a case where the recording medium is a plain paper.

According to the invention, since the image forming apparatus further comprises a transporting section for the recording medium and transport speed controlling section, when the recording medium detecting section detects that the recording medium is an OHP sheet, then the transport speed controlling section controls the transport speed of the recording medium that is transported by the transporting section, into a speed lower than a speed in a case where the recording medium is a plain paper. Thus, a movement and a flow of the fixing solution at the time of application of the fixing solution can be prevented more reliably.

Furthermore, in the invention it is preferable that the heating section heats the recording medium to a temperature higher than a glass transition temperature of the toner constituting the toner image.

According to the invention, heating is performed by the heating section to a temperature higher than the glass transition temperature of the toner constituting the toner image (temperature higher than the glass transition temperature by 5 to 10° C., for example). By a synergistic action of the fixing solution and heating, the toner is quickly softened, and thus the adhesion between the toner particles and between the toner and the recording medium increases. As a result, for example, a movement and a flow of the toner caused by the fixing solution at the time of application of the fixing solution can be prevented more reliably. It should be noted that in heat fixing, even when heating is performed to a temperature higher than the glass transition temperature of the toner by about 5 to 10° C., toner images cannot be successively and smoothly fixed onto the recording media.

Furthermore, in the invention, it is preferable that the heating section heats the recording medium to a temperature higher than a softening temperature of the toner constituting the toner image.

According to the invention, heating is performed by the heating section to a temperature higher than the softening temperature of the toner constituting the toner image (temperature higher than the softening temperature of the toner by 5 to 10° C., for example). By a synergistic action of the fixing solution and heating, the toner is quickly softened, and thus the adhesion between the toner particles and between the toner and the recording medium increases. As a result, for example, a movement and a flow of the toner caused by the fixing solution at the time of application of the fixing solution can be prevented more reliably.

Furthermore, in the invention it is preferable that, heat is applied by the heating section and the fixing solution is applied by the fixing solution applying section, to at least an area in which the toner image is formed of the recording medium.

According to the invention, heat and the fixing solution are applied to at least an area in which the toner image is formed of the recording medium. Thus, heat in an amount compensating for the temperature drop of the toner and the recording medium caused by application of the fixing solution can be supplied on the spot at the moment that the fixing solution is applied. As a result, the temperatures of the toner, the recording medium, and the fixing solution immediately after application of the fixing solution are higher than those in a case where the fixing solution is applied without heating. Thus, the fixing solution is dispersed and permeates through the toner image more quickly immediately after the application, and the toner is swollen and/or softened promptly in a large area, so that the toner image can be fixed onto the recording medium quickly and the toner image has sufficient adhesion to the recording medium. Furthermore, by increasing the temperature of the fixing solution after the application, the fixing solution can be dried quickly.

Furthermore, in the invention it is preferable that the fixing solution applying section further comprises a fixing solution warming section for warming the fixing solution that is to be applied to the recording medium.

According to the invention, a fixing solution warming section for warming the fixing solution that is to be applied to the recording medium is provided. Thus, the temperature of the toner can be prevented more reliably from being lowered by application of the fixing solution. More specifically, by keeping the fixing solution at a temperature at which components in the fixing solution hardly volatize, a synergistic action of the fixing solution and heating to the toner is exerted more efficiently. Accordingly, the toner images can be successively and smoothly transferred and fixed onto the recording media.

Furthermore, in the invention it is preferable that the fixing solution contains an adhesive for improving an adhesion of the toner to the recording medium.

According to the invention, the fixing solution contains an adhesive in addition to the organic solvent and water. Thus, the adhesion between the toner particles and between the toner and the recording medium further increases. Accordingly, the toner image can be fixed onto the recording medium more reliably.

Furthermore, in the invention it is preferable that the toner contains polyester and a wax having a glass transition temperature lower than that of the polyester.

According to the invention, it is preferable to use toner that contains polyester and a wax having a glass transition temperature lower than that of the polyester. Polyester is easily swollen and/or softened by the organic solvent contained in the fixing solution, and becomes transparent when the polyester is swollen and/or softened. Thus, when a color toner image formed by superimposing a plurality of colors of toner images is fixed using the fixing solution, due to subtractive color mixing in which the polyester becomes transparent and only the color of a coloring agent is vividly developed, a fixed image having a vivid color can be obtained. Furthermore, the wax having a glass transition temperature lower than that of the binding resin is easily softened by heat, and thus the adhesion between the toner particles and between the toner and the recording medium increases even at a temperature lower than the glass transition temperature of the toner. Thus, for example, a flow and an aggregation of the toner at the time of application of the fixing solution can be prevented more reliably. Furthermore, since the wax is softened and the fixing solution easily permeates through the inside of toner particles from a portion where the wax is present, at the time of application of the fixing solution, the entire toner is swollen and/or softened quickly. Thus, the toner image can be fixed at sufficient adhesion when being transferred to the recording medium, and the color can be sufficiently developed when superimposing toner images.

Furthermore, in the invention it is preferable that the toner has a volume average particle size of 2 to 7 μm.

According to the invention, in the image forming apparatus of the invention, toner having a volume average particle size of 2 to 7 μm is used. Thus, a fixed image having a well developed color can be obtained. Furthermore, regarding a fixed image on an OHP sheet, a transparent image becomes light on an over head projector.

BRIEF DESCRIPTION OF THE

Other and further objects, features, and advantages of the invention will be more explicit from the following detailed description taken with reference to the drawings wherein.

DETAILED DESCRIPTION

Figure 1:
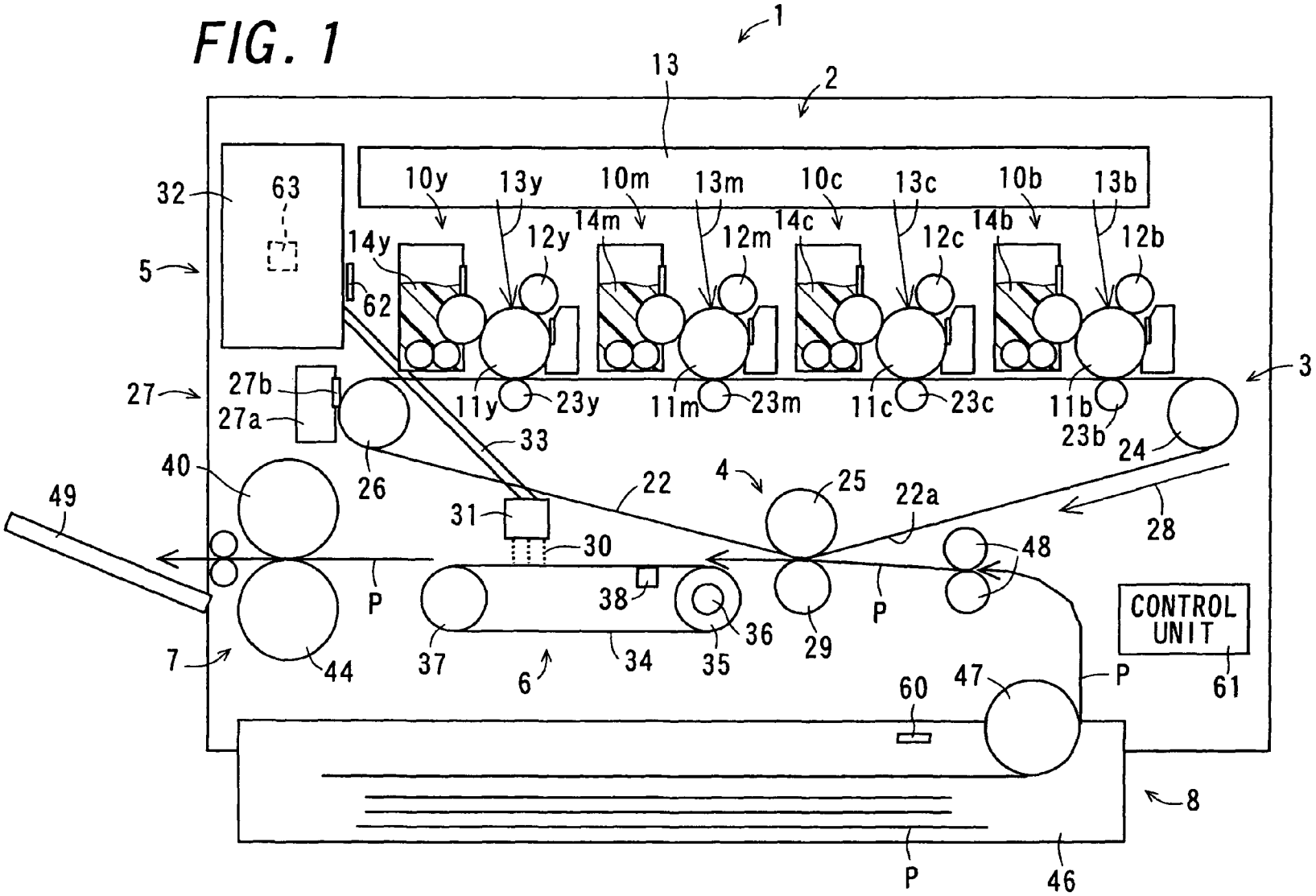
FIG. 1 is a cross-sectional view schematically showing the configuration of an image forming apparatus according to a first embodiment of the invention.

Now referring to the drawings, preferred embodiments of the invention are described below.

Figure 2:
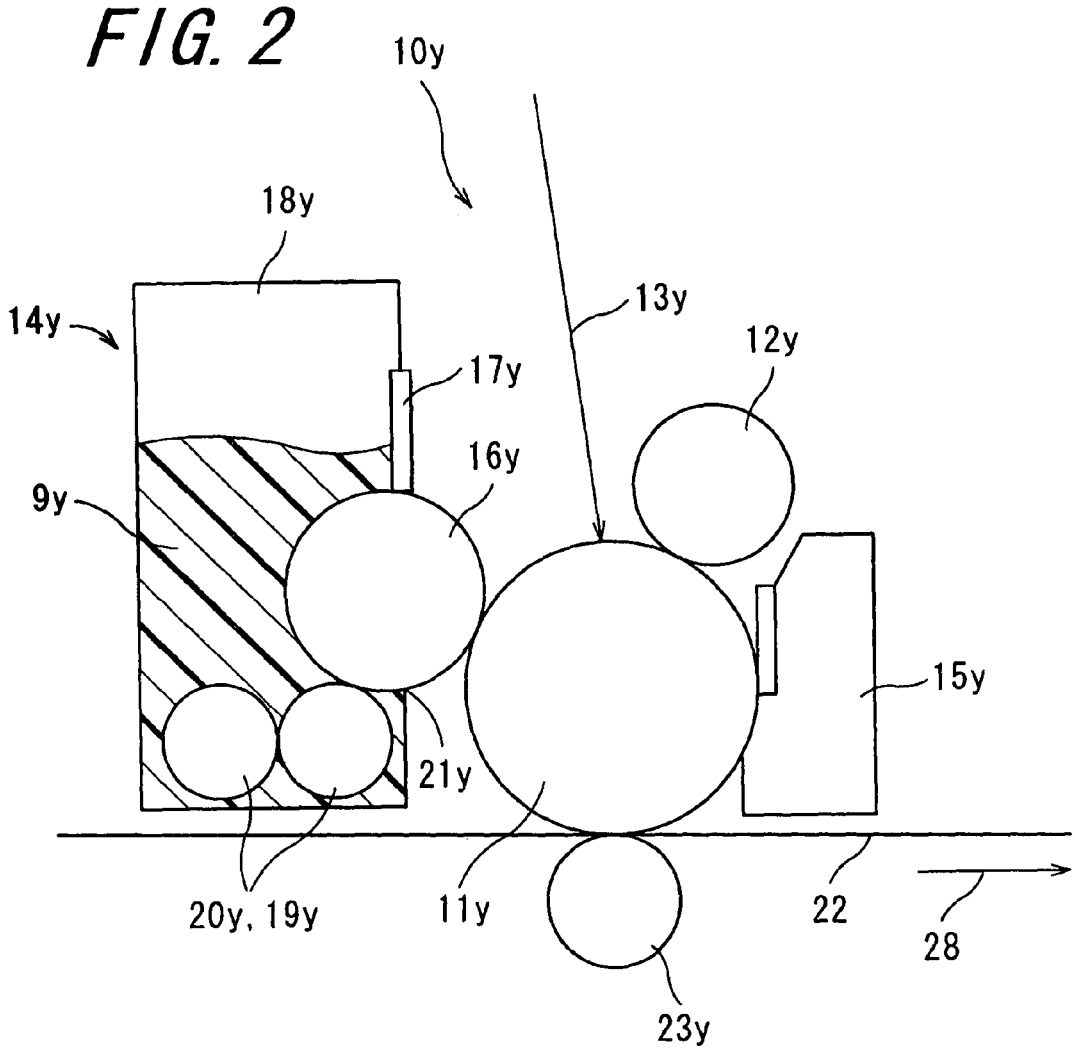
FIG. 2 is a cross-sectional view showing an enlarged configuration of the main portion of the image forming apparatus shown in FIG. 1.
Figure 3:
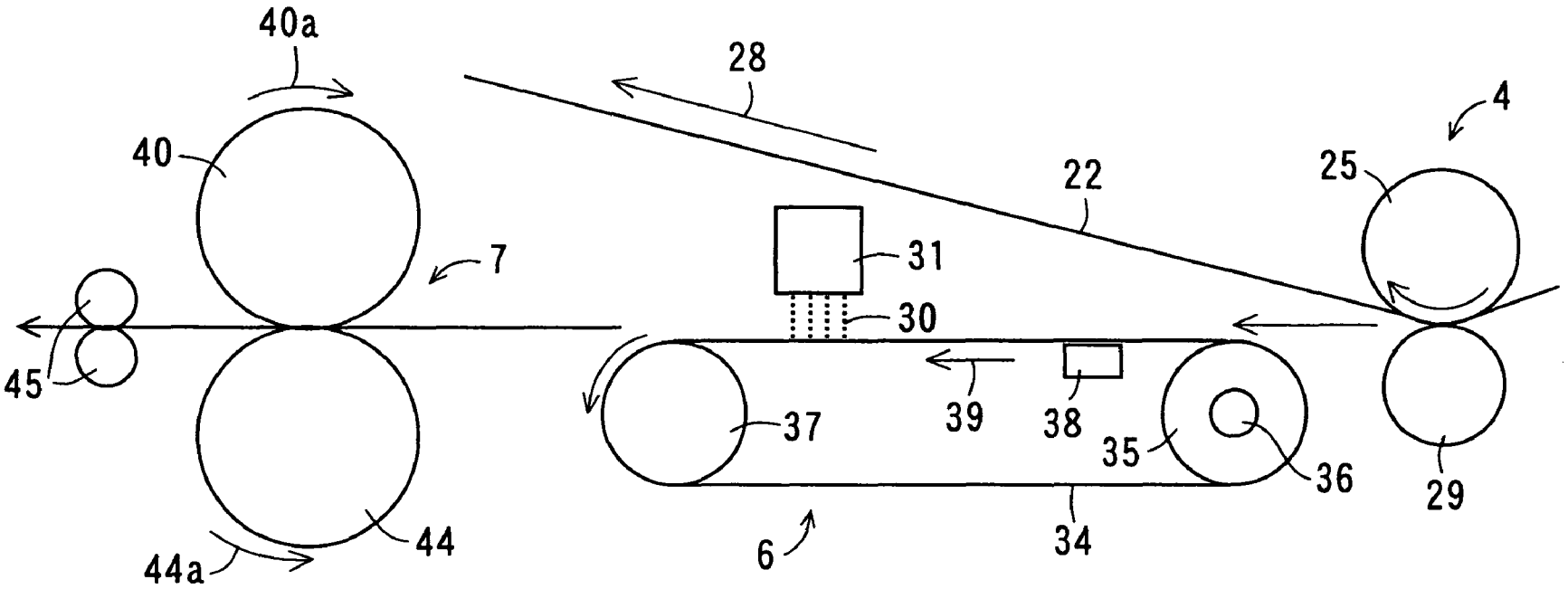
FIG. 3 is a cross-sectional view showing an enlarged configuration of the main portions of the image forming apparatus shown in FIG. 1.
Figure 4:
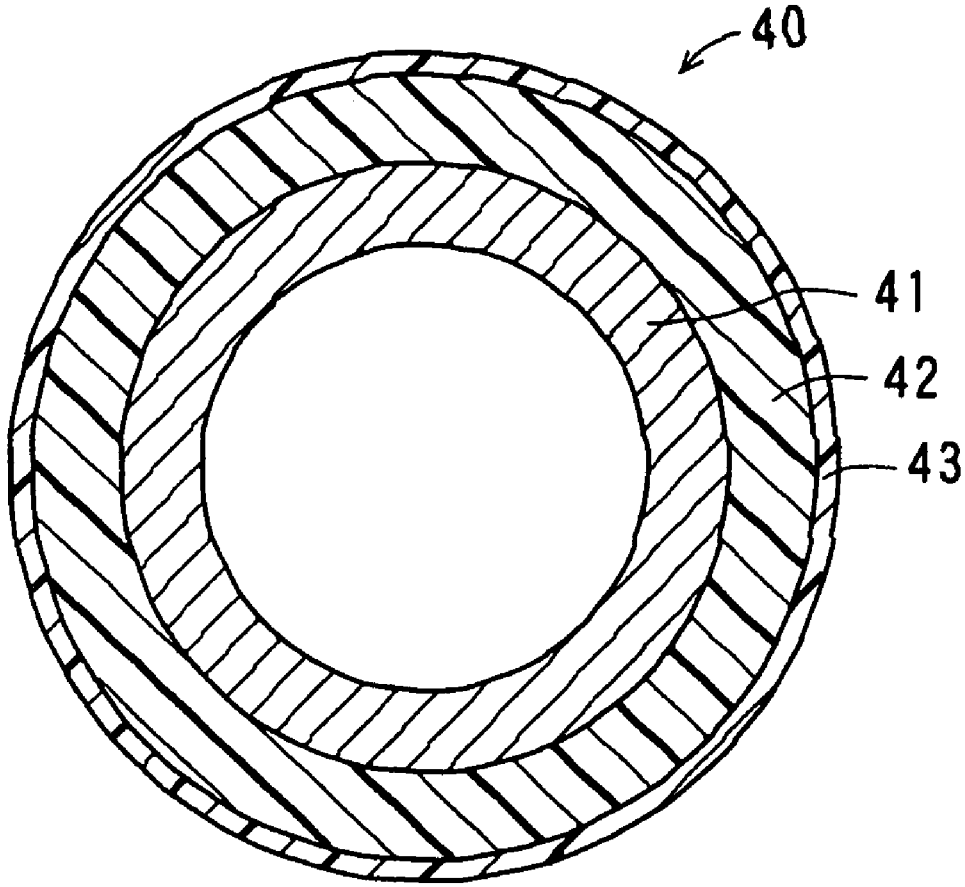
FIG. 4 is a cross-sectional view schematically showing the configuration of a fixing roller.

FIG. 1 is a cross-sectional view schematically showing the configuration of an image forming apparatus 1 according to a first embodiment of the invention. FIG. 2 is a cross-sectional view showing an enlarged configuration of the main portion (a toner image forming section 2, which will be described later) of the image forming apparatus 1 shown in FIG. 1. FIG. 3 is a cross-sectional view showing an enlarged configuration of the main portions (a transferring section 4, a part of fixing solution applying section 5, a transporting section 6, and a fixing section 7, which will be described later) of the image forming apparatus 1 shown in FIG. 1. FIG. 4 is a cross-sectional view schematically showing the configuration of a fixing roller 40, which will be described later. The image forming apparatus 1 is an electrophotographic image forming apparatus with a tandem structure in which toner images in four colors, yellow, magenta, cyan, and black are sequentially transferred while being superimposed one on another. The image forming apparatus 1 includes the toner image forming section 2, an intermediate transferring section 3, the transferring section 4, the fixing solution applying section 5, the transporting section 6, the fixing section 7, and a recording medium feeding section 8.

The toner image forming section 2 includes image forming units 10*y*, 10*m*, 10*c*, and 10*b*. The image forming units 10*y*, 10*m*, 10*c*, and 10*b* are arranged in one line in this order in the rotational drive direction (sub-scanning direction) of an intermediate transfer belt 22 (described later), that is, from the upstream side in the direction of the arrow 28. The image forming units 10*y*, 10*m*, 10*c*, and 10*b* form toner images of the respective colors by forming electrostatic latent images corresponding to image information regarding the respective colors that is inputted as digital signals or the like, supplying toners of the corresponding colors to the electrostatic latent images, and developing the electrostatic latent images. More specifically, the image forming unit 10*y* forms a toner image corresponding to yellow image information, the image forming unit 10*m* forms a toner image corresponding to magenta image information, the image forming unit 10*c* forms a toner image corresponding to cyan image information, and 10*b* forms a toner image corresponding to black image information.

The image forming unit 10*y* includes a photoreceptor drum 11*y*, a charging roller 12*y*, an optical scanning unit 13, a developing device 14*y*, and a drum cleaner 15*y*.

The photoreceptor drum 11*y* is a roller member that is supported rotatably about the axis thereof by a driving section (not shown) and that has a photosensitive layer having a surface on which an electrostatic latent image and eventually toner image is formed. The photoreceptor drum 11*y* may include, for example, a conductive substrate (not shown) and a photosensitive layer that is formed on the surface of the conductive substrate. As the conductive substrate, for example, a cylindrical, columnar, or sheet-like conductive substrate can be used. Of these, a cylindrical conductive substrate is preferable. As the photosensitive layer, for example, an organic or inorganic photosensitive layer can be used. The organic photosensitive layer may be formed by laminating a resin layer containing a charge generating material and a resin layer containing a charge transporting material, or may be one resin layer containing a charge generating material and a charge transporting material, for example. The inorganic photosensitive layer may contain one or at least two selected from among, for example, zinc oxide, selenium, and amorphous silicon. An undercoat layer may be disposed between the conductive substrate and the photosensitive layer. Furthermore, a surface layer mainly for protecting the photosensitive layer may be provided on the surface of the photosensitive layer. In this embodiment, a photoreceptor drum having a diameter of 30 mm is used that includes an aluminum bare tube serving as the conductive substrate and connected to a ground potential (GND), and an organic photosensitive layer having a thickness of 20 μm and formed on the surface of the aluminum bare tube. The organic photosensitive layer is formed by laminating a charge generating layer and a charge transporting layer. Furthermore, in this embodiment, the photoreceptor drum 11*y* is driven to rotate clockwise at a peripheral velocity of 100 mm/s.

The charging roller 12*y* is a roller member that is supported rotatably about the axis thereof by a driving section (not shown) and that charges the surface of the photoreceptor drum 11*y* to a predetermined polarity and potential. The charging roller 12*y* is connected to a power source (not shown), and charges the surface of the photoreceptor drum 11*y* by discharging electricity when a voltage is applied from the power source to the charging roller 12*y*. In this embodiment, the charging roller 12*y* charges the surface of the photoreceptor drum 11*y* to −600 V. Instead of the charging roller 12*y*, it is possible to use a brush-type charging device, a charger-type charging device, and a corona charging device such as scorotron, for example.

The optical scanning unit 13 forms an electrostatic latent image corresponding to yellow image information on the surface of the photoreceptor drum 11*y* that has been charged by the charging roller 12*y*, by irradiating the surface of the photoreceptor drum 11*y* with signal light 13*y* corresponding to the yellow image information. As the optical scanning unit 13, for example, a semiconductor laser can be used. In this embodiment, an electrostatic latent image having an exposure potential of −70 V is formed on the surface of the photoreceptor drum 11*y* that has been charged to −600 V.

The developing device 14*y* includes a developing roller 16*y*, a developing blade 17*y*, a developing tank 18*y*, agitating rollers 19*y* and 20*y*.

The developing roller 16*y* carries a yellow toner 9*y* on the surface thereof, and supplies the yellow toner 9*y* to an electrostatic latent image on the surface of the photoreceptor drum 11*y* at the closest portion (development nip portion) between the developing roller 16*y* and the photoreceptor drum 11*y*. The developing roller 16*y* is a roller member that is accommodated inside the developing tank 18*y*, that partially protrudes to the outside from an opening 21*y* formed on a face, of the developing tank 18*y*, facing the photoreceptor drum 11*y*, that abuts against the photoreceptor drum 11*y*, that can be driven to rotate about the axis thereof, and that includes a fixed magnetic pole (not shown) inside the developing roller 16*y*. The developing roller 16*y* is driven to rotate in the direction opposite to that of the photoreceptor drum 11*y*. Accordingly, at the development nip portion, the developing roller 16*y* and the photoreceptor drum 11*y* rotate in the same direction. Furthermore, the developing roller 16*y* is connected to a power source (not shown), and a dc voltage (development voltage) is applied from the power source to the developing roller 16*y*. Thus, the yellow toner 9*y* on the surface of the developing roller 16*y* is smoothly supplied to an electric latent image. In this embodiment, the developing roller 16*y* rotate at a peripheral velocity of 150 mm/s, which is 1.5 times as high as the peripheral velocity of the photoreceptor drum 11*y*. A dc voltage of −240 V is applied as a development potential to the developing roller 16*y*. A yellow toner layer on the surface of the developing roller 16*y* is brought in contact with the photoreceptor drum 11*y* at the development nip portion, thereby supplying the yellow toner 9*y* to the electric latent image.

The developing blade 17*y* is a plate member that has one end supported by the developing tank 18*y* and the other end abutting against the surface of the developing roller 16*y*, and that makes a yellow toner layer carried on the surface of the developing roller 16*y* uniform (regulates the layer).

The developing tank 18*y* is a container member that has the opening 21*y* formed as described above on the face facing the photoreceptor drum 11*y* and that has an internal space. The internal space of the developing tank 18*y* accommodates the developing roller 16*y*, the agitating rollers 19*y* and 20*y*, and stores the yellow toner 9*y*. In accordance with the status of the yellow toner 9*y* consumed, the developing tank 18*y* is replenished with the yellow toner 9*y* from a toner cartridge (not shown). In this embodiment, the yellow toner 9*y* is used in the form of a two-component developer that is a mixture with a magnetic carrier. However, the invention is not limited to this, and the yellow toner 9*y* may be used also in the form of a one-component developer that contains only the yellow toner 9*y*.

The agitating rollers 19*y* and 20*y* are screw members that abut against each other in the internal space of the developing tank 18*y* and that can be driven to rotate about the axes thereof. The agitating roller 19*y* faces the developing roller 16*y* and abuts against the developing roller 16*y*. The agitating rollers 19*y* and 20*y* are driven to rotate, thereby mixing the yellow toner 9*y* that is supplied from the toner cartridge (not shown) to the developing tank 18*y* and the magnetic carrier that is filled in advance inside the developing tank 18*y*, and supplying the mixture to the vicinity of the developing roller 16*y*.

In this embodiment, the photoreceptor drum 11*y*, the developing roller 16*y*, the developing blade 17*y*, and the agitating rollers 19*y* and 20*y* abut against each other. However, the invention is not limited to this, and the photoreceptor drum 11*y* and the developing roller 16*y*, the developing roller 16*y* and the developing blade 17*y*, the developing roller 16*y* and the agitating roller 19*y*, and the agitating roller 19*y* and the agitating roller 20*y* may be each spaced away from each other.

After a yellow toner image on the surface of the photoreceptor drum 11*y* is transferred to the intermediate transfer belt 22 as will be described later, the drum cleaner 15*y* removes and recovers the yellow toner 9*y* remaining on the surface of the photoreceptor drum 11*y*.

With the image forming unit 10*y*, the surface of the photoreceptor drum 11*y* that has been charged by the charging roller 12*y* is irradiated with the signal light 13*y* corresponding to yellow image information from the optical scanning unit 13, thereby forming an electrostatic latent image, and the yellow toner 9*y* is supplied from the developing device 14*y* to the electrostatic latent image, thereby developing the electrostatic latent image, so that a yellow toner image is formed. The yellow toner image is transferred to the intermediate transfer belt 22 that abuts against the surface of the photoreceptor drum 11*y* and that is driven to rotate in the direction of the arrow 28, as will be described later. The yellow toner 9*y* remaining on the surface of the photoreceptor drum 11*y* is removed and recovered by the drum cleaner 15*y*. This operation for forming an image (toner image) is repeated. The image forming units 10*m*, 10*c*, and 10*b* have the same configuration as that of the image forming unit 10*y*, expect for using a magenta toner 9*m*, a cyan toner 9*c*, and a black toner 9*b* instead of the yellow toner 9*y*. Thus, the same reference numbers are given to these image forming units, the symbols "m" for magenta, "c" for cyan, and "b" for black are respectively added to the end of the reference numbers, and a description of these image forming units has been omitted.

The toners 9*y*, 9*m*, 9*c*, and 9*b* (hereinafter, generally referred to as "toner 9" unless otherwise specified) contains a binding resin, a coloring agent, and a releasing agent.

There is no specific limitation regarding the binding resin, as long as the binding resin is swollen and/or softened by a fixing solution 30, which will be described later. Examples of the biding resin include a homopolymer of polystyrene or styrene substituent, styrene-based copolymer that is a copolymer of two or more selected from the group consisting of styrene and substituents thereof, polyvinyl chloride, polyvinyl acetate, polyethylene, polypropylene, polyester, and polyurethane. The binding resin may be used alone or in combination of two or more. Of these binding resins, a binding resin having a softening temperature of 100 to 150° C. and a glass transition temperature of 50 to 80° C. is preferable, and polyester having the above-described softening temperature and glass transition temperature is particularly preferable, as a binding resin for color toner, in view of preservability, durability, and control of swelling and/or softening with the fixing solution 30, for example. Polyester is easily swollen and/or softened by an easily available organic solvent, and becomes transparent when the polyester is swollen and/or softened. In a case where the binding resin is this polyester, when a multicolored toner image formed by superimposing two or more selected from among yellow, magenta, cyan, and black toner images is fixed onto a recording medium P using the fixing solution 30, the polyester becomes transparent, and thus the color can be sufficiently developed due to subtractive color mixing. Furthermore, even when a resin having a softening temperature or molecular weight higher than that of a binding resin contained in toner that is used in heat fixing, fixing with the fixing solution 30 is possible. When a resin having a high softening temperature or molecular weight is used, deterioration caused by the load applied during development is prevented, and thus high-quality images can be obtained for a long period of time. In this embodiment, polyester having a glass transition temperature of 60° C. and a softening temperature of 120° C. is used.

As the coloring agent, pigments and dyes for toner that have been conventionally used in electrophotographic image formation can be used. Of these, a pigment that is not dissolved in the fixing solution 30 is preferable in order to prevent a blur and the like from being caused by application of the fixing solution 30 especially when a toner images is transferred and fixed onto the recording medium P. Examples of the pigment include organic pigments such as azo-based pigment, benzimidazolone-based pigment, quinacridone-based pigment, phthalocyanine-based pigment, isoindolinone-based pigment, isoindoline-based pigment, dioxazine-based pigment, anthraquinone-based pigment, perylene-based pigment, perinone-based pigment, thioindigo-based pigment, quinophthalone-based pigment, and metal complex-based pigment, inorganic pigments such as carbon black, titanium oxide, molybdenum red, chrome yellow, titan yellow, chromium oxide, and Berlin blue, and metal powers such as aluminum powder. The pigment may be used alone or in combination of two or more.

As the releasing agent, for example, a wax can be used. As the wax, waxes that are usually used in this field can be used. Of these, a wax that is swollen or softened by the fixing solution 30 is preferable. Specific examples thereof include a polyethylene wax, a polypropylene wax, and a paraffin wax. In this embodiment, a low molecular weight polypropylene wax having a glass transition temperature of 50° C., which is lower than that of the binding resin of the toner 9, and a softening temperature of 70° C. is used. When a wax having a softening temperature lower than that of the binding resin is used, the wax is softened at a temperature lower than the softening temperature of the binding resin, in other words, the toner 9, and thus the adhesion between particles of the toner 9 and between the toner 9 and the recording medium P increases. Accordingly, at the time of application of the fixing solution 30 to a toner image, for example, a flow and an aggregation of the toner 9 can be prevented. Furthermore, since the wax is softened, the fixing solution 30 easily permeates through the inside of toner particles from a portion where the wax is present. Thus, at the time of application of the fixing solution 30, the entire toner 9 is swollen and/or softened quickly, so that a sufficient fixing strength can be obtained when a toner image is transferred and fixed onto the recording medium P, and the color can be sufficiently developed when toner images are superimposed.

In addition to the binding resin, the coloring agent, and the releasing agent, the toner 9 may contain one or at least two commonly used toner additives such as charging control agent, fluidity improver, fixing accelerator, and conductive material. The toner 9 can be produced using known methods such as pulverizing method in which a coloring agent, a releasing agent, and the like are dispersed in a binding resin and then pulverized, polymerization method in which a coloring agent, a releasing agent, biding resin monomers, and the like are uniformly dispersed, and the binding resin monomers are copolymerized, and an aggregation method in which binding resin particles, a coloring agent, a releasing agent, and the like are aggregated in the presence of an aggregating agent, and the obtained aggregate is heated. It should be noted that an uneven shape is more preferable than a perfect sphere as the shape of the toner 9 in order to increase the surface area. Accordingly, the toner 9 is more easily brought in contact with the fixing solution 30, and thus the amount of the fixing solution 30 consumed can be reduced, and toner images can be fixed and dried quickly.

There is no specific limitation regarding the volume average particle size of the toner 9, but the volume average particle size is preferably 2 to 7 μm. When a toner having a small particle size as this is used, the toner surface area per unit area of a toner image increases, and the contact area with the fixing solution 30 increases. Thus, the toner 9 can be fixed onto the recording medium P quickly. The quick fixing reduces the amount of the fixing solution 30 consumed. Furthermore, since the fixing solution 30 is dried promptly, for example, wrinkles or curling is not generated in the recording medium P. As the particle size of the toner 9 is smaller, the coverage on the recording medium P at the same weight is improved. Thus, high-quality images can be formed with a smaller amount of the toner 9 attached. In other words, the amount of toner consumed can be reduced, and at the same time the image quality can be improved. In a case where the volume average particle size is less than 2 μm, the fluidity is lowered, and thus supply of toner to the photoreceptor drum, agitation of toner in the developing device, and charge of toner in a developing operation become insufficient. As a result, the amount of toner becomes insufficient, and toner having the opposite polarity increases, for example. Accordingly, high-quality toner images cannot be obtained in development. On the other hand, in a case where the volume average particle size is more than 7 μm, the content of toner having a large particle size that is not easily swollen to its center increases, so that the color of a fixed image is poorly developed, and a transparent image becomes dark on an OHP sheet.

The toner 9 preferably contains a binding resin, a pigment (coloring agent), and a wax (releasing agent), and has a softening temperature of 100 to 130° C., a glass transition temperature of 50 to 80° C., and a volume average particle size of 2 to 7 μm, for example. The toner 9 having a high softening temperature is highly durable against the load in development, but fixing and color development in heat fixing are insufficient. However, even toner having a high softening temperature as this can be preferably used for forming a fixed image having a high definition, because the image forming apparatus 1 using the fixing solution 30 employs a method in which the toner is chemically swollen and/or softened. In this embodiment, as the toner 9, a non-magnetic dielectric toner is used that contains 12 wt % of the coloring agent, 7 wt % of the wax, and polyester (binding resin having a glass transition temperature of 60° C. and a softening temperature of 120° C.) as the rest, with respect to the total amount of the toner 9, that has a volume average particle size of 6 μm, and that is negatively charged. In order to obtain a predetermined image density (reflection density of 1.4 when measured with a 310 produced by X-Rite) using this toner, toner in an amount of 5 $g/m^2$ per unit area is necessary.

The intermediate transferring section 3 includes the intermediate transfer belt 22, intermediate transfer rollers 23*y*, 23*m*, 23*c*, and 23*b*, supporting rollers 24, 25, and 26, and a belt cleaner 27.

The intermediate transfer belt 22 is a toner image carrying section in the form of an endless belt that is extended by the supporting rollers 24, 25, and 26 and that forms a looped movement path, and rotates in the direction of the arrow 28 at a peripheral velocity substantially the same as that of the photoreceptor drums 11*y*, 11*m*, 11*c*, and 11*b*. There is no specific limitation regarding the configuration of the intermediate transfer belt 22, as long as the fixing solution 30 does not permeate through the inside of the intermediate transfer belt 22. The intermediate transfer belt 22 may be formed, for example, by laminating a film-like base member, an elastic resin layer that is formed on the surface of the film-like base member, and a fluororesin-containing cover layer that is formed on the surface of the elastic resin layer, or by laminating a film-like base member and a fluororesin-containing cover layer that is formed on the surface of the film-like base member. The surface of the cover layer serves as a toner image carrying face 22*a*. As the film-like base member, for example, films obtained by molding a resin material such as polyimide and polycarbonate, or a rubber material such as fluororubber can be used. The fluororesin-containing cover layer includes a fluororesin such as PTFE (polytetrafluoroethylene), PFA (copolymer of tetrafluoroethylene and perfluoroalkyl vinyl ether), and their mixtures. A conductive material may be added to one or at least two of the film-like base member, the elastic resin layer, and the fluororesin-containing cover layer, in order to the electrical resistivity of the intermediate transfer belt 22. Examples of the conductive material include furnace black, thermal black, channel black, and graphite carbon. The shape of the intermediate transfer belt 22 is not limited to a belt, and may be a drum, for example. In this embodiment, the intermediate transfer belt 22 in the form of a belt is used in which a cover layer having a thickness of 20 μm and made of a fluororesin composition that contains PTFE and PFA in a ratio (weight ratio) 8:2 is layered on a base material layer having a thickness of 100 μm and made of a polyimide film, and carbon black is added to the layers in order to provide an appropriate electrical resistivity to the intermediate transfer belt. The toner image carrying face 22*a* of the intermediate transfer belt 22 abuts against the photoreceptor drums 11*y*, 11*m*, 11*c*, and 11*b* in this order from the upstream side in the rotational direction (direction of the arrow 28). The position at which the intermediate transfer belt 22 abuts against the photoreceptor drums 11*y*, 11*m*, 11*c*, and 11*b* corresponds to a transfer position (intermediate transfer nip portion) of toner images of the respective colors to the intermediate transfer belt 22.

The intermediate transfer rollers 23*y*, 23*m*, 23*c*, and 23*b* are roller members that are opposed to the photoreceptor drums 11*y*, 11*m*, 11*c*, and 11*b* with the intermediate transfer belt 22 interposed therebetween, abut against the rear side of the toner image carrying face 22*a*, and can be driven to rotate about the axes thereof by a driving section (not shown). As the intermediate transfer rollers 23*y*, 23*m*, 23*c*, and 23*b*, for example, a roller member including a metal shaft and a conductive layer that covers the surface of the metal shaft is used. The shaft may be made of a metal such as stainless steel. There is no specific limitation regarding the diameter of the shaft, but the diameter is preferably 8 to 10 mm. The conductive layer is for applying a high voltage uniformly to the intermediate transfer belt 22, and made of a conductive elastic member, for example. As the conductive elastic member, a conductive elastic member that is usually used in this field can be used. Examples thereof include a conductive elastic member in which a conductive material such as carbon black is dispersed in a matrix of, for example, ethylene propylen dien rubber (EPDM), EPDM foam, or urethane foam. An intermediate transfer bias having the polarity opposite to the charge polarity of toner is applied in constant voltage control to the intermediate transfer rollers 23*y*, 23*m*, 23*c*, and 23*b* in order to transfer toner images formed on the surface of the photoreceptor drums 11*y*, 11*m*, 11*c*, and 11*b*, to the intermediate transfer belt 22. Accordingly, yellow, magenta, cyan, and black toner images formed on the photoreceptor drums 11*y*, 11*m*, 11*c*, and 11*b* are sequentially transferred while being superimposed one on another at the intermediate transfer nip portion on the toner image carrying face 22*a* of the intermediate transfer belt 22, and thus a multicolored toner image is formed. It should be noted that when only a part of yellow, magenta, cyan, and black image information is inputted, a toner image is formed only at an image forming unit corresponding to the color of image information that has been inputted, among the image forming units 10*y*, 10*m*, 10*c* and 10*b*.

The supporting rollers 24, 25, and 26 can be driven to rotate about the axes thereof by a driving section (not shown), and rotate the intermediate transfer belt 22 in the direction of the arrow 28 while extending the intermediate transfer belt 22 between these supporting rollers. As the supporting rollers 24, 25, and 26, for example, pipe-like aluminum rollers having a diameter of 30 mm and a wall thickness of 1 mm are used. The supporting roller 25 is electrically grounded. The supporting roller 25 also has a function as the transferring section 4 as will be described later.

The belt cleaner 27 removes toner remaining on the toner image carrying face 22*a* of the intermediate transfer belt 22, after a toner image on the toner image carrying face 22*a* has been transferred by the transferring section 4 to the recording medium P, which will be described later. The belt cleaner 27 includes a cleaning blade 27*a* and a toner container 27*b*. The cleaning blade 27*a* is a plate member that is opposed to the supporting roller 26 with the intermediate transfer belt 22 interposed therebetween, that is pressed against the toner image carrying face 22*a* by a pressing section (not shown), and that scrapes toner or paper particles remaining on the toner image carrying face 22*a*. As the cleaning blade 27*a*, for example, a blade made of a rubber material such as urethane rubber can be used. The toner container 27*b* stores remaining toner, offset toner, and paper particles that have been scraped by the cleaning blade 27*a*.

With the intermediate transferring section 3, toner images of the respective colors that are formed on the photoreceptor drums 11*y*, 11*m*, 11*c*, and 11*b* are transferred while being superimposed one on another at the intermediate transfer nip portion on the toner image carrying face 22*a* of the intermediate transfer belt 22, and thus a toner image is formed. After the toner image has been transferred by the transferring section 4 to the recording medium P, toner and the like remaining on the toner image carrying face 22*a* of the intermediate transfer belt 22 are removed by the belt cleaner 27, and a next toner image is sequentially transferred to the toner image carrying face 22*a*.

The transferring section 4 includes the supporting roller 25 and a transfer roller 29. The transfer roller 29 is a roller member that abuts against the supporting roller 25 with the intermediate transfer belt 22 interposed therebetween, that can be driven to rotate about the axis thereof, and that functions mainly as a pressing roller. As the transfer roller 29, a transfer roller that is usually used in this field can be used. In this embodiment, a roller member is used in which a carbon black-containing urethane rubber layer having a thickness of 4 mm is provided on the surface of a core having a diameter of 10 mm. Furthermore, in this embodiment, the transfer roller 29 is pressed against the supporting roller 25 at a linear load of 1 N/cm. In this embodiment, a transfer bias voltage of +1 kV is applied to the core of the transfer roller 29 when a toner image is transferred to the recording medium P. With the transferring section 4, when a toner image that is swollen and/or softened is transferred to the abutting portion (transfer nip portion) between the supporting roller 25 and the transfer roller 29, the recording medium P is fed from the recording medium feeding section 8 (described later) in synchronization with this transportation, and the toner image on the intermediate transfer belt 22 is pressed and transferred to the surface of the recording medium P, so that the toner image is carried on the surface of the recording medium P.

The fixing solution applying section 5 includes a droplet supplying section 31, a fixing solution storage tank 32, a supply tube 33, a recording medium detecting section 60, and a control unit 61 for controlling the entire operation of the image forming apparatus 1 and serving also as a droplet size controlling section, and applies the fixing solution 30 to the recording medium P carrying the toner image that is transported by a transport belt 34 (described later) while being heated. The control unit 61 is realized by CPU (central processing unit), and has a storing portion, a computing portion and a controlling portion.

The droplet supplying section 31 is provided above the transport belt 34 in the vertical direction with space interposed therebetween, in the downstream of a temperature sensor 38 in the rotational drive direction (direction of the arrow 39) of the transport belt 34, and supplies droplets of the fixing solution 30 to the toner image carrying face of the recording medium P carrying the toner image that is placed on the transport belt 34 and transported in the direction of the arrow 39. As the droplet supplying section 31, for example, a nozzle array can be used. The nozzle array is a fine-droplet ejecting device having a plurality of minute nozzles that can apply fine droplets of the fixing solution 30 in a non-contact state in response to electric control signals. The pitch at which the minute nozzles are arranged is set such that ejected droplets of the fixing solution completely cover a face to which the fixing solution is to be applied of the recording medium P, when the droplets have landed on the face. The nozzle array can change the droplet size of the fixing solution that is to be ejected from the minute nozzles, in response to electric control signals that are inputted. Generally, the nozzle array can change the droplet size within a range of 30 to 200 μm, and the amount of droplets attached within a range of about 0.5 to 3.5 mg/cm$^2$, with respect to the fixing solution 30 that is applied to the recording medium P. There is no specific limitation regarding the amount of the fixing solution 30 applied, but the droplet size is preferably about 150 μm, and the attached amount is preferably about 2.5 mg/cm$^2$, for a general plain paper. On the other hand, when about 2.5 mg/cm$^2$ of the fixing solution 30 is applied to a recording medium such as an OHP sheet and coated paper having a resin layer on the surface thereof, the fixing solution 30 hardly permeates or does not permeate at all through the recording medium, and thus a toner flow is caused in attached droplets, so that the image quality is significantly deteriorated. Thus, for a recording medium having a good surface smoothness, such as an OHP sheet and coated paper, the droplet size is preferably about 30 μm, and the amount of the fixing solution 30 applied is preferably about 0.5 mg/cm$^2$. Accordingly, a toner flow in droplets can be prevented, and thus a good image quality can be obtained. Specific examples of the nozzle array include a piezo nozzle array using piezoelectric elements, a pressure nozzle array applying the pressure to the fixing solution 30, a thermal nozzle array using bubbles in a film boiling phenomenon, a nozzle array provided with fluid nozzles, and an ultrasonic nebulizer. For example, when a piezo nozzle array is used, the droplet size may be controlled by adjusting as appropriate the voltage applied to piezoelectric elements. Furthermore, when a nozzle array provided with fluid nozzles is used, a ratio in which an air flow and the fixing solution 30 are mixed in the fluid nozzles may be adjusted. When an ultrasonic nebulizer is used, the frequency, the amplitude, or the like of ultrasonic waves may be adjusted. When the fixing solution 30 is applied in a non-contact state in this manner, the problem (disturbance of toner images at the nip portion between a fixing solution applying member such as an application roller and the recording medium P, and offset of toner to the fixing solution applying member, for example) that is likely to occur when the fixing solution 30 is applied to the recording medium P in a contact state using the fixing solution applying member is not caused. Thus, the fixing solution 30 can be applied to the recording medium P without disturbing toner images, and thus high-quality images can be obtained.

The fixing solution storage tank 32 is a container member that has an internal space, and stores the fixing solution 30 in the internal space. The fixing solution storage tank 32 may be installed as a fixed tank inside the image forming apparatus 1, in which when the fixing solution 30 has run out, the fixing solution 30 is replenished from a fixing solution supply port (not shown). Alternatively, the fixing solution storage tank 32 may be provided as a cartridge detachable from the image forming apparatus 1, in which when the fixing solution 30 is used up, the fixing solution storage tank 32 is replaced by a new tank.

As the fixing solution 30 that is stored inside the fixing solution storage tank 32, any conventionally known fixing solution containing a liquid component that can swell and/or soften the binding resin, the releasing agent, and the like contained in the toner 9 can be used. Of these, a fixing solution containing water and one or at least two organic solvents is preferable. Herein, as the organic solvents, an organic solvent that can swell and/or soften the binding resin, the releasing agent, and the like, and that can be dissolved or dispersed in water. Examples thereof include hydrofluoroethers, and mixtures of hydrofluoroethers and another organic solvent (hereinafter, referred to as a "cosolvent"). The surface tension and the viscosity of hydrofluoroethers are small, and thus hydrofluoroethers permeate also between toner particles and between toner and a recording medium. When hydrofluoroethers are used as a mixture with a cosolvent, the cosolvent is transported to an interface between particles of the toner 9, a contact face between the toner 9 and a recording medium, and the like, so that the toner 9 can be instantly swollen and/or softened. Furthermore, the latent heat of vaporization of hydrofluoroethers is small, and thus hydrofluoroethers are shortly dried even at room temperature. Specific examples of the hydrofluoroethers include methyl nonafluorobutyl ether, methyl nonafluoroisobutyl ether ($C_3F_9OCH_3$), ethyl nonafluorobutyl ether, ethyl nonafluoroisobutyl ether ($C_3F_9OC_2H_5$), and 1,1,2,2-tetrafluoroethyl-2,2,2-trifluoroethyl ether ($CHF_2CF_2OCH_2CF_3$). The hydrofluoroethers may be used alone or in combination of two or more. There is no specific limitation regarding the content of the hydrofluoroethers, but the content is preferably 50 to 95 wt %, and more preferably 60 to 90 wt %, with respect to the total amount of the fixing solution 30. When the content of the hydrofluoroethers is less than 50 wt %, the fixing solution 30 permeates less, and in a case where the amount of toner constituting a toner image is large, toner only on the surface is swollen and/or softened, and toner at a contact face between a toner image and the recording medium P, which is a toner carrying member, is not sufficiently swollen or softened. Accordingly, the adhesion of the toner image to the recording medium P is lowered, and an image that is firmly fixed onto the recording medium P cannot be obtained. When the content of the hydrofluoroethers is more than 95 wt %, a swelling and/or softening action of the toner 9 is reduced, and thus a sufficient fixing strength cannot be obtained.

Specific examples of the cosolvent include alcohols (such as methanol, ethanol, propanol, isopropanol, and butanol), ketones (such as acetone, methyl ethyl ketone, methyl butyl ketone, methyl isobutyl ketone, and diethyl ketone), ethers (such as methyl ethyl ether, diethyl ether, methyl butyl ether, methyl isobutyl ether, and dimethyl ether), and esters of carboxylic acid (such as fomic acid, acetic acid, proprionic acid, and butyric acid) and lower alcohol (such as methanol, ethanol, and propanol). Of these, ethers and esters are preferable, and esters are particularly preferable. In ethers, diethyl ether is particularly preferable. In esters, ethyl acetate, methyl acetate, ethyl formate, methyl formate, and the like are preferable, and ethyl acetate is particularly preferable. These cosolvents volatize at room temperature, and have an excellent action of swelling and/or softening the binding resin, typically polyester, of the toner 9. The cosolvent may be used alone or in combination of two or more. There is no specific limitation regarding the usage ratio between the hydrofluoroethers and the cosolvent, but it is preferable to use 1 to 100 weight parts of the cosolvent with respect to 100 weight parts of the hydrofluoroethers. Furthermore, the content of the cosolvent in the fixing solution 30 is preferably 5 wt % or more, and more preferably 10 wt % or more, with respect to the total amount of the fixing solution 30, in a state where the above-described usage ratio between the cosolvent and the hydrofluoroethers is realized. Water is used in an amount of the rest of the organic solvent, or the organic solvent and the cosolvent, such that the total amount is 100.

In addition to water and the organic solvent, the fixing solution 30 may contain a surfactant, a dispersing aid, or the like. The surfactant improves, for example, the dispersibility of the organic solvent in the fixing solution 30, and the wettability of the toner 9 and the fixing solution 30. Examples of the surfactant include anionic surfactants, for example, higher alcohol sulfuric acid ester salt such as lauryl sulfuric acid ester sodium salt, higher fatty acid metal salt such as sodium oleate, fatty acid derivative sulfuric acid ester salt, or phosphoric acid ester, cationic surfactants, for example, quaternary ammonium salt or heterocyclic amine, amphoteric surfactants, for example, amino acid ester or amino acid, non-ionic surfactants, polyoxyalkylene alkylether, and polyoxyethylene alkylamine. The surfactant may be used alone or in combination of two or more. Examples of the dispersing aid include coupling agents such as diethylene glycol, triethylene glycol, polyethylene glycol, monobutyl ether, or diethylene glycol monomethyl ether. The dispersing aid may be used alone or in combination of two or more. In addition, the fixing solution 30 may include an adhesive. There is no specific limitation regarding the adhesive, as long as the adhesive can be dissolved or dispersed in the fixing solution 30, and examples thereof include an emulsion adhesive in which a rubber-based adhesive mainly made of polymeric elastomer such as chloroprene rubber, nitrile rubber, or SBR rubber, vinyl acetate, EVA, and a synthetic resin such as acrylic resin are dispersed uniformly in water. With this configuration, the adhesion of the toner 9 to the recording medium P is realized not only by swelling and/or softening of the toner but also by the adhesive, and thus the adhesion of the toner 9 to the recording medium P can be improved, so that the fixing strength of a toner image onto the recording medium P can be improved.

The supply tube 33 is a pipe member that is connected at one end to the droplet supplying section 31 and at the other end to the fixing solution storage tank 32, and that supplies the fixing solution 30 inside the fixing solution storage tank 32 to the droplet supplying section 31. A fixing solution replenishing section (not shown) is provided on the supply tube 33. The fixing solution 30 is replenished, for example, based on the remaining amount of the fixing solution 30 detected by a solution amount detecting section (not shown) that is provided in the droplet supplying section 31. A detection result of the solution amount detecting section is inputted to the storing portion of the control unit 61 for controlling the entire operation of the image forming apparatus 1. The computing portion of the control unit 61 retrieves, from the storing portion, the solution amount at which the fixing solution is to be replenished, that has been inputted to the storing portion in advance, and the solution amount detected by the solution amount detecting section, and compares the solution amounts. In a case where the control unit 61 judges that the amount of the solution current remaining is smaller than the solution amount at which the fixing solution 30 is to be replenished, then a control signal is sent to the fixing solution replenishing section, thereby replenishing the droplet supplying section 31 with the fixing solution 30. When the control unit 61 judges, for example, based on the detection result of the solution amount detecting section, that a predetermined amount of the fixing solution 30 has been filled inside the droplet supplying section 31, the control unit 61 sends a control signal to the fixing solution replenishing section, thereby stopping the replenishment of the fixing solution 30. As the fixing solution replenishing section, for example, an electromagnetic valve can be used.

A fixing solution warming section 62 may be provided in the vicinity of at least one of the droplet supplying section 31, the fixing solution storage tank 32, and the supply tube 33. The fixing solution warming section 62 is for keeping the fixing solution 30 at a temperature that is higher than room temperature and at which a component such as the organic solvent contained in the fixing solution 30 does not volatize so much, and specific examples thereof include a commonly used heating device such as various heaters. The heating with the fixing solution warming section 62 is controlled by the control unit 61 based on the detection result of a temperature sensor 63 that is provided at the droplet supplying section 31, the fixing solution storage tank 32, or the supply tube 33, in a state where the temperature at which the fixing solution 30 is to be kept is set in advance.

The recording medium detecting section 60 detects the type of a recording medium, and inputs the detection result to the storing portion of the control unit 61. Herein, the type of a recording medium refers to, for example, the material of the recording medium, the thickness of the recording medium, or a marking on the recording medium. Furthermore, it is also possible to apply a configuration in which a control panel (not shown) on the upper face (not shown) of the image forming apparatus 1 is provided with an area for specifying the type of a recording medium, and the type of a recording medium is specified by a user and inputted to the control unit 61. Alternatively, the type of a recording medium may be detected by the control unit 61 retrieving information regarding the type of the recording medium from among image information that is inputted to the control unit 61 from an external information terminal connected to the image forming apparatus 1. Of these, it is preferable to judge the type of a recording medium based on the thickness of the recording medium. Examples of the recording medium include a plain paper, color copying paper, OHP sheet, and coated paper, and their thicknesses are all different from each other. Thus, when thickness values for respective recording media are inputted to the storing portion of the control unit 61, the computing portion of the control unit 61 can easily judge the type of a recording medium by comparing the detection result of the recording medium detecting section 60 and the thickness values of the respective recording media. Examples of the recording medium detecting section 60 include a reflector photosensor and a marking sensor. The recording medium detecting section 60 is provided, for example, at a recording medium cassette 46 (described later) or a manual feeding tray (not shown).

Based on the detection result of the recording medium detecting section 60, the control unit 61 controls the droplet size of the fixing solution 30 that is to be ejected from the droplet supplying section 31. The detection result of the recording medium detecting section 60 is inputted to the storing portion of the control unit 61. In a case where the detection result relates to the thickness of a recording medium, the control unit 61 judges the type of the detected recording medium, by retrieving a table sheet indicating the relationship between the type and the thickness of recording media, that has been inputted to the storing portion in advance, and the latest detection result of the recording medium detecting section 60, and comparing these values at the computing portion. Based on the judgment result, the control unit 61 sends a control signal from the controlling portion to the droplet supplying section 31, thereby changing the droplet size of the fixing solution that is to be ejected from the droplet supplying section 31. In a case where a piezo nozzle array is used as the droplet supplying section 31, the droplet size can be changed by sending a control signal to a power source (not shown) that is connected to the droplet supplying section 31, and adjusting as appropriate the voltage that is applied from the power source to a piezoelectric element of the droplet supplying section 31. Accordingly, an optimum amount of the fixing solution 30 can be applied for each recording medium, and thus the fixing solution 30 can be efficiently used without wasting the fixing solution 30. Furthermore, since the fixing solution 30 is applied in an optimum amount, a good image can be obtained without disturbing a toner image.

With the fixing solution applying section 5, the fixing solution 30 can be applied to the toner image carrying face on the recording medium P carrying the toner image that is placed on the transport belt 34 and transported in the direction of the arrow 39, in accordance with the type of the recording medium P.

The transporting section 6 includes the transport belt 34, a drive roller 35, a tension roller 37, and the temperature sensor 38. The transport belt 34 is an endless belt that is extended by the drive roller 35 and the tension roller 37 and that forms a looped movement path, and transports the recording medium P carrying a toner image that has been transferred by the transferring section 4, in the direction of the arrow 39, that is, toward the fixing section 7, while the recording medium P is heated. On the transportation path, the fixing solution 30 is applied by the fixing solution applying section 5 to the recording medium P carrying the toner image. As the transport belt 34, for example, a belt can be used in which a cover layer having a thickness of 10 μm and made of PTFE is provided on at least a recording medium transporting face of a polyimide film having a thickness of 100 μm and provided with the conductivity by a conductant agent added thereto. There is no specific limitation regarding the transport speed of the transport belt 34, but the transport speed is preferably about half (about 50 mm/sec) of the transport speed (generally, about 100 mm/sec) for a plain paper when using the recording medium P through which the fixing solution 30 hardly permeates or does not permeate at all, such as an OHP sheet and coated paper. With this configuration, for example, a movement and a flow of droplets of the fixing solution 30 on the recording medium P are prevented. The drive roller 35 can be driven to rotate about the axis thereof by a driving section (not shown). For the drive roller 35, for example, a hollow roller made of a metal such as aluminum can be used. A heating section 36 is provided inside the drive roller 35. The heating section 36 keeps the transport belt 34 that is extended by the drive roller 35 at a constant temperature by means of the control unit 61, which will be described later. The recording medium P carrying a toner image that is transported by the transport belt 34 is indirectly heated by the transport belt 34. As the heating section 36, for example, non-contact type heaters such as a halogen lamp or an infrared heater, or a heating section in the shape of a roller or a plate can be used. In this embodiment, a halogen lamp is used as the heating section 36, the temperature of the transport belt 34 is kept at 70° C., and a toner image on the recording medium P is heated to about 56° C., which is slightly lower than the glass transition temperature of the toner 9. The tension roller 37 applies a predetermined tensile force to the transport belt 34 such that the transport belt 34 is not loosened. The tension roller 37 includes, for example, a metal shaft and a cover layer that is formed on the surface of the metal shaft. Alternatively, the tension roller 37 includes only a metal shaft. The metal shaft may be made of stainless steel, and the cover layer may be made of fluororesin, for example. The temperature sensor 38 is provided in the vicinity of the rear side of a face, on which the recording medium P carrying a toner image is transported, of the transport belt 34, in the downstream of the drive roller 35 and the upstream of the droplet supplying section 31 in the transport direction (direction of the arrow 39) on the transport belt 34. The detection result of temperature sensor 38 is inputted to the storing portion of the control unit 61. The computing portion of the control unit 61 retrieves, from the storing portion, the preset temperature of the transport belt 34 that has been inputted to the storing portion in advance, and the temperature detected by the temperature sensor 38, and compares the temperatures. In a case where the computing portion judges that the detected temperature is lower than the preset temperature, then a control signal is accordingly sent to a power source (not shown) of the heating section 36, and a necessary amount of voltage is applied from the power source to the heating section 36, so that heat is generated by the heating section 36. In this manner, the transport belt 34 is kept at a substantially constant temperature.

In this embodiment, settings are applied in which the temperature of the transport belt 34 is 70° C., and the temperature of a toner image that is transported to the fixing section 7 and to which the fixing solution 30 is applied is lower than the glass transition temperature (60° C.) of the toner. However, there is no limitation to this, and it is also possible to apply settings in which the temperature of the transport belt 34 is 80° C., and the temperature of a toner image that is transported to the fixing section 7 is higher than the glass transition temperature (60° C.) of the toner. With this setting, the toner is softened before the fixing solution 30 is applied, the adhesion between the toner particles and between the toner and the recording medium increases, and thus at the time of applying the fixing solution 30, a movement and a flow of the toner caused by application of the fixing solution can be prevented. Furthermore, it is preferable to apply settings in which the temperature of the transport belt 34 is 140° C., and the temperature of a toner image that is transported to the fixing section 7 is higher than the softening temperature (120° C.) of the toner. With this setting, the toner is sufficiently softened, and the adhesion between the toner particles and between the toner and the recording medium further increases, and thus at the time of applying the fixing solution 30, for example, a movement and a flow of the toner caused by application of the fixing solution can be prevented more reliably. With the transporting section 6, the fixing solution 30 is applied to the recording medium P to which a toner image has been transferred by the transferring section 4 while the recording medium P is heated to a preset temperature, and thus the recording medium P carrying the toner image is transported to the fixing section 7 after the toner constituting the toner image is sufficiently swollen and/or softened.

The fixing section 7 includes a fixing roller 40, a pressing roller 44, and paper discharge rollers 45.

The fixing roller 40 is a roller member that is supported rotatably about the axis thereof by a driving section (not shown) and that abuts against the pressing roller 44, and includes a core 41, an elastic layer 42 that is formed on the surface of the core 41, and a surface layer 43 that is formed on the surface of the elastic layer 42. The elastic layer 42 is made of an elastic material. The elastic material is preferably a rubber material, and particularly preferably a rubber material that is not swollen by the fixing solution 30. When a rubber material that is not swollen is used, the outer diameter of the fixing roller 40 is unchangeably kept, and thus the transport speed of the recording medium P can be kept substantially constant at the abutting portion (fixing nip portion) between the fixing roller 40 and the pressing roller 44. Examples of the rubber material that is not swollen by the fixing solution 30 include ethylene propylene rubber (EPDM), butyl rubber, nitrile rubber, chloroprene rubber, and styrene-butadiene rubber. The surface layer 43 is made of a synthetic resin, preferably fluororesin. Examples of the fluororesin include PTFE (polytetrafluoroethylene), PFA (copolymer of tetrafluoroethylene and perfluoroalkyl vinylether), FEP (copolymer of tetrafluoroethylene and hexafluoropropylene), ETFE (copolymer of tetrafluoroethylene and ethylene), PVDF (polyvinylidene fluoride), PCTFE (polychlorotrifluoroethylene), and mixtures of two or more of these resins. In this embodiment, the fixing roller 40 having an external diameter of 30 mm is used in which the elastic layer 42 having a thickness of 3 mm and made of EPDM rubber (hardness: 20 degrees (JIS-A)) is formed on the surface of the core 41, and the surface layer 43 having a thickness of 80 μm and made of PFA is formed on the surface of the elastic layer 42.

The pressing roller 44 is a roller member that is supported so as to be rotated by rotation of the fixing roller 40 and that abuts against the fixing roller 40, and includes a core, an elastic layer, and a surface layer as in the fixing roller 40. The materials used for forming the core, the elastic layer, and the surface layer are similar to those for the fixing roller 40. In this embodiment, the pressing roller 44 having an external diameter of 30 mm is used in which the elastic layer having a thickness of 3 mm and made of EPDM rubber (hardness: 50 degrees (JIS-A)) is formed on the surface of the core, and the surface layer having a thickness of 80 μm and made of PFA is formed on the surface of the elastic layer. Furthermore, in this embodiment, the pressing roller 44 abuts against the fixing roller 40 at a pressing force of 10 N/cm. When the recording medium P carrying a toner image formed by the toner 9 that is swollen and/or softened, to which heat has been applied by the transporting section 6, and the fixing solution 30 has been applied by the fixing solution applying section 5, passes the fixing nip portion, the toner image is pressed against the recording medium P by the fixing roller 40 and the pressing roller 44, and thus the toner image is fixed as an image onto the recording medium P. The paper discharge rollers 45 are a pair of roller members that discharge the recording medium P onto which an image has been fixed, that is transported from the fixing nip portion between the fixing roller 40 and the pressing roller 44, to a paper discharge tray 49 provided at an external side face of the image forming apparatus 1. The pair of rollers abut against each other, and are supported rotatably about the axes thereof. With the fixing section 7, when the recording medium P carrying a toner image passes the fixing nip portion, the toner image is fixed as an image onto the recording medium P, and the recording medium P is discharged via the paper discharge rollers 45 to the paper discharge tray 49. At the transporting section 6, which is before the fixing section 7, the toner image on the recording medium P to which the fixing solution 30 has been applied by the fixing solution applying section 5 is fixed onto the recording medium P with sufficient adhesion by an action of the fixing solution 30, and the recording medium P on which the image has been formed can be obtained without further processing. However, when pressure is further applied by the fixing section 7, the fixing strength, the image quality, and the like can be further improved.

The recording medium feeding section 8 includes the recording medium cassette 46 storing the recording media P, a pick-up roller 47 feeding the recording media P one by one to the transport path, and a pair of registration rollers 48 feeding the recording medium P to the transfer nip portion in synchronization with transportation of a toner image on the intermediate transfer belt 22 to the nip portion. With the recording medium feeding section 8, the recording media P that are stored in the recording medium cassette 46 are fed one by one to the transport path by the pick-up roller 47, and then to the transfer nip portion by the registration rollers 48. At the transfer nip portion, a toner image is transferred to the recording medium P.

With the image forming apparatus 1, a toner image formed by the toner image forming section 2 on the intermediate transfer belt 22 is transferred by the transferring section 4 to the recording medium P, fixed onto the recording medium P by non-contact application of the fixing solution 30 by the fixing solution applying section 5 while the toner image is heated, fixed by the fixing section 7 more firmly onto the recording medium P, and then discharged to the paper discharge tray 49.

Figure 5:
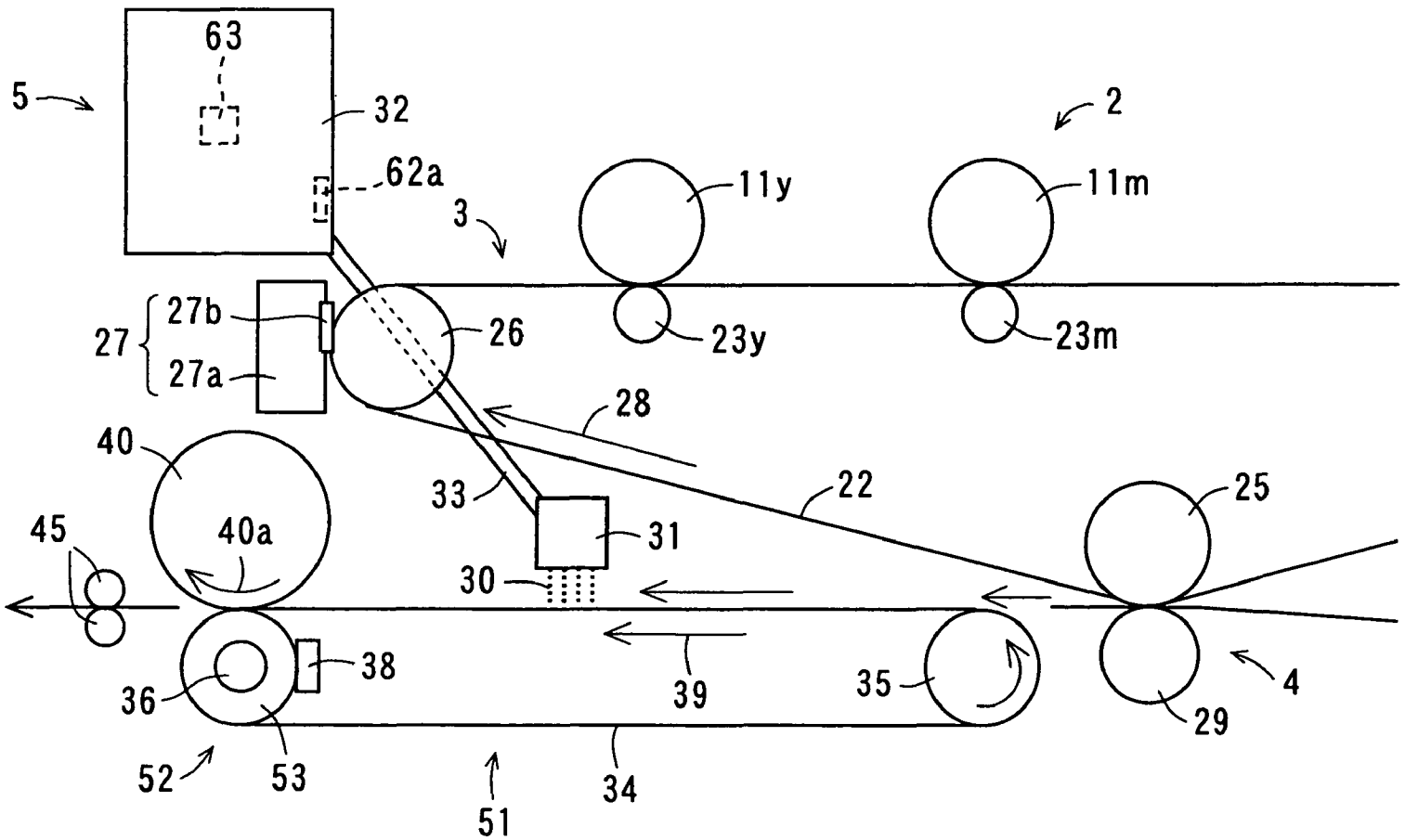
FIG. 5 is a cross-sectional view schematically showing the configuration of the main portions of an image forming apparatus according to a second embodiment of the invention.

FIG. 5 is a cross-sectional view schematically showing the configuration of the main portions of an image forming apparatus 50 according to a second embodiment of the invention. The image forming apparatus 50 is similar to the image forming apparatus 1. The components corresponding between these image forming apparatuses are given the same reference numbers or not shown in the drawing, and a description thereof is not repeated. The image forming apparatus 50 is characterized by a comprising transporting section 51 and a fixing section 52, instead of the transporting section 6 and the fixing section 7 in the image forming apparatus 1. Also, the image forming apparatus 50 is characterized by further comprising a fixing solution warming section **62*a* inside the fixing solution storage tank 32 of the fixing solution applying section 5**.

The fixing solution warming section **62*a* and the temperature sensor 63 are provided inside the fixing solution storage tank 32 in the fixing solution applying section 5 as described above, and are configured so as to keep the fixing solution 30 at a constant temperature. As the fixing solution warming section 62*a*, a heater is used. The detection result of the temperature sensor 63 is inputted to the storing portion of the control unit 61. The computing portion of the control unit 61 retrieves, from the storing portion, the preset warming temperature that has been inputted to the storing portion in advance, and the temperature detected by the temperature sensor 63, and compares these temperatures. In a case where the control unit 61 judges that the temperature detected by the temperature sensor 63 is lower than the preset warming temperature, then the controlling portion of the control unit 61 accordingly sends a control signal to a power source (not shown) of the fixing solution warming section 62*a*, and thus the voltage is applied to the fixing solution warming section 62*a*, so that the fixing solution 30 is heated to the preset warming temperature. In this embodiment, the preset temperature at which the fixing solution 30** is to be kept is 40° C.

With this configuration, the temperature of the toner 9 can be prevented from being too low at the time of application of the fixing solution 30. Accordingly, a synergistic action of the softening by heat and the softening by the fixing solution is exerted at the time of fixing, and thus a good fixing can be secured.

The transporting section 51 includes the transport belt 34, the drive roller 35, a tension roller 53, and the temperature sensor 38. The tension roller 53 can be driven to rotate about the axis thereof by a driving section (not shown), or can be rotated by rotation of the drive roller 35, and extends the transport belt 34 in cooperation with the drive roller 35. Furthermore, the tension roller 53 abuts against the fixing roller 40 of the fixing section 52 with the transport belt 34 interposed therebetween, and the heating section 36 is provided inside the tension roller 53. In other words, the tension roller 53 has a function of applying a tensile force to the transport belt 34 and a function of heating the transport belt 34 to a preset temperature in the transporting section 51, and a function as a pressing roller in the fixing section 52. Furthermore, the temperature sensor 38 detects the surface temperature of the tension roller 53, and thus is provided in the vicinity of the surface of the tension roller 53. It is possible to obtain in advance the correlation between the surface temperature of the tension roller 53, and the surface temperature of the transport belt 34 below the droplet supplying section 31 in the vertical direction (area to which the fixing solution is applied of the transport belt 34). Accordingly, by controlling the surface temperature of the tension roller 53, it is possible to control the surface temperature of the transport belt 34, in particular, a portion reaching the area to which the fixing solution 30 is applied of the transport belt 34. Furthermore, the temperature of a toner image is substantially equal to the surface temperature of the transport belt 34. Thus, by controlling the surface temperature of the portion reaching the area to which the fixing solution 30 is applied, it is possible to control the temperature of the toner image that is transported to the fixing section 52. The surface temperature of the tension roller 53 is controlled, as in the temperature control for the transport belt 34 in the image forming apparatus 1, by the control unit 61 judging the detection result of the temperature sensor 38, and sending, based on the judgment result, a control signal to a power source (not shown) that is connected to the heating section 36. In this embodiment, settings are applied in which the surface temperature of the tension roller 53 is 70° C., and the temperature of the area to which the fixing solution is applied of the transport belt 34 is slightly lower than the glass transition temperature (60° C.) of the toner 9. With this setting, the temperature of a toner image that is transported to the fixing section 52 is substantially equal to the temperature of the area to which the fixing solution is applied of the transport belt 34.

In this embodiment, settings are applied in which the surface temperature of the tension roller 53 is 70° C., and the temperature of a toner image that is transported to the fixing section 52 is lower than the glass transition temperature (60° C.) of the toner 9. However, there is no limitation to this, and it is also possible to apply settings, for example, in which the surface temperature of the tension roller 53 is 80° C., and the temperature of the area to which the fixing solution is applied of the transport belt 34 is higher than the glass transition temperature (60° C.) of the toner 9. In this case, the softening of the toner 9 starts before the fixing solution 30 is applied, and the adhesion between particles of the toner 9 and between the toner 9 and a recording medium increases, an thus, for example, a movement and a flow of the toner 9 caused by application of the fixing solution 30 can be reliably prevented. Furthermore, it is also possible to apply settings in which the surface temperature of the tension roller 53 is 140° C., and the temperature of the area to which the fixing solution is applied of the transport belt 34 is higher than the softening temperature (120° C.) of the toner 9. In this case, the toner 9 is sufficiently softened, and thus the adhesion between particles of the toner 9 and between the toner 9 and a recording medium further increases, and thus a movement and a flow of the toner 9 caused by application of the fixing solution 30 can be prevented more reliably.

With this configuration, heat in an amount compensating for the temperature drop of the toner 9 and the recording medium P caused by application of the fixing solution 30 can be supplied on the spot. As a result, the temperatures of the toner 9, the recording medium P, and the fixing solution 30 immediately after application of the fixing solution 30 are high as appropriate. Thus, the fixing solution 30 is dispersed and permeates through a toner image quickly, and the toner 9 is swollen and/or softened promptly in a large area, so that the toner image can be fixed onto the recording medium P with sufficient adhesion. Furthermore, since the temperature of the fixing solution 30 after the application is increased, the fixing solution 30 that does not participate in swelling and/or softening the toner 9 can be quickly dried.

With the transporting section 51, when the recording medium P to which a toner image has been transferred by the transferring section 4 is placed on the transport belt 34 and transported in the direction of the arrow 39, the recording medium P is transported to the fixing section 52 in a state where the toner image is almost fixed onto the recording medium, by heat indirectly applied by the transport belt 34, and by the fixing solution 30 applied by the fixing solution applying section 5.

The fixing section 52 includes the fixing roller 40, the tension roller 53, the paper discharge rollers 45. The tension roller 51 functions as a heating roller as descried above. The recording medium P to which a toner image has been fixed, that is transported from the transporting section 51 to the abutting portion (fixing nip portion) between the fixing roller 40 and the tension roller 53 is heated and pressed at the abutting portion, and thus the toner image is more firmly fixed onto the recording medium P, and an image is formed on the recording medium P. The recording medium P on which the image has been formed is discharged via the paper discharge rollers 45 to a paper discharge tray (not shown) that is provided outside the image forming apparatus 50.

In the image forming apparatuses of the invention, the materials, the layer structure, and the size of the intermediate transfer belt, the transfer belt, and the rollers, for example, are not limited to those described above, and the materials, the layer structure, and the size, for example, that are usually used in the field of electrophotographic image formation can be used without any processing or with appropriate modification.

Furthermore, endless members such as an endless belt can be used instead of the rollers. Although the intermediate transfer belt, the transfer belt, and the like were described as endless members, they may be in the form of rollers.

The image forming apparatuses of the invention were described as color image forming apparatuses of a tandem type in the foregoing embodiments, but there is no limitation to this. For example, the image forming apparatuses may be color image forming apparatuses of a so-called four-rotation type in which an image of one color is superimposed every time the intermediate transfer belt rotates once. Furthermore, the image forming apparatuses are not limited to color image forming apparatuses, and may be monochromatic image forming apparatuses.

The color image forming apparatuses of the invention are used as, for example, copiers, printers, facsimiles, or compound machines of two or more of these apparatuses.

The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section for forming a toner image;

a transferring section for transferring, to a recording medium, the toner image that has been formed by the toner image forming section;

a fixing solution applying section for applying, to a surface of the recording medium, a fixing solution containing water and an organic solvent which fixing solution softens and/or swells toner, and fixes the toner onto the recording medium; and a heating section for heating another side of the recording medium different from one side to which the fixing solution is applied, before or during the fixing solution is applied to the one side of the recording medium by the fixing solution applying section, wherein the fixing solution applying section includes:

a droplet supplying section for supplying the fixing solution to the recording medium while forming the fixing solution into droplets;

a recording medium detecting section for detecting a type of the recording medium; and a droplet size controlling section for controlling a size of the droplets of the fixing solution formed by the droplet supplying section, based on a result detected by the recording medium detecting section, and wherein the fixing solution applying section applies the fixing solution in the form of droplets to the recording medium while the size of the droplets is controlled based on the type of the recording medium.

2. The image forming apparatus of claim 1, wherein the fixing solution applying section applies the droplets which are controlled by the droplet size controlling section so as to have a smaller size than that of droplets supplied in a case where the recording medium is a plain paper, from the droplet supplying section to the recording medium, when the recording medium detecting section detects that the recording medium is a plastic sheet or a recording medium having a resin layer on the surface thereof.

3. The image forming apparatus of claim 1, further comprising:

a transporting section for transporting the recording medium; and a transport speed controlling section for controlling a transport speed of the recording medium that is transported by the transporting section, wherein, when the recording medium detecting section detects that the recording medium is a plastic sheet or a recording medium having a resin layer on the surface thereof, then the transport speed controlling section controls the transport speed of the recording medium that is transported by the transporting section, into a speed lower than a speed in a case where the recording medium is a plain paper.

4. The image forming apparatus of claim 1, wherein the heating section heats the recording medium to a temperature higher than a glass transition temperature of the toner constituting the toner image.

5. The image forming apparatus of claim 1, wherein the heating section heats the recording medium to a temperature higher than a softening temperature of the toner constituting the toner image.

6. The image forming apparatus of claim 1, wherein heat is applied by the heating section and the fixing solution is applied by the fixing solution applying section, to at least an area in which the toner image is formed of the recording medium.

7. The image forming apparatus of claim 1, wherein the fixing solution applying section further comprises a fixing solution warming section for warming the fixing solution that is to be applied to the recording medium.

8. The image forming apparatus of claim 1, wherein the fixing solution contains an adhesive for improving an adhesion of the toner to the recording medium.

9. The image forming apparatus of claim 1, wherein the toner contains polyester and a wax having a glass transition temperature lower than that of the polyester.

10. The image forming apparatus of claim 9, wherein the toner has a volume average particle size of 2 to 7 μm.

* * * * *